US011532260B2

(12) United States Patent
Huang et al.

(10) Patent No.: US 11,532,260 B2
(45) Date of Patent: Dec. 20, 2022

(54) DISPLAY PANEL AND DISPLAY DEVICE

(71) Applicant: WUHAN TIANMA MICRO-ELECTRONICS CO., LTD., Wuhan (CN)

(72) Inventors: Wei Huang, Wuhan (CN); Lu Xiao, Wuhan (CN); Qin Yue, Wuhan (CN); Yangzhao Ma, Wuhan (CN); Zhongjie Zhang, Wuhan (CN)

(73) Assignee: WUHAN TIANMA MICRO-ELECTRONICS CO., LTD., Wuhan (CN)

( * ) Notice: Subject to any disclaimer, the term of this patent is extended or adjusted under 35 U.S.C. 154(b) by 0 days.

(21) Appl. No.: 17/400,156

(22) Filed: Aug. 12, 2021

(65) Prior Publication Data

US 2021/0375182 A1 Dec. 2, 2021

(30) Foreign Application Priority Data

Jun. 7, 2021 (CN) ..... 202110633264.0

(51) Int. Cl.
*G09G 3/20* (2006.01)

(52) U.S. Cl.
CPC ... *G09G 3/2003* (2013.01); *G09G 2300/0452* (2013.01)

(58) Field of Classification Search
CPC ... G09G 2300/0426; G09G 2300/0452; G09G 3/2003; G09G 3/32
See application file for complete search history.

(56) References Cited

U.S. PATENT DOCUMENTS

2018/0166512 A1* 6/2018 Hack ..... H01L 27/3218
2021/0098539 A1* 4/2021 Zhang ..... H01L 27/3216
2021/0313402 A1* 10/2021 Zhou ..... H01L 27/3216

FOREIGN PATENT DOCUMENTS

CN 106960863 * 7/2017
CN 110620135 A 12/2019
CN 110767733 A * 2/2020 ..... H01L 27/3218
CN 111292673 A 6/2020

* cited by examiner

*Primary Examiner* — Kenneth Bukowski
(74) *Attorney, Agent, or Firm* — Kilpatrick Townsend & Stockton, LLP

(57) ABSTRACT

Disclosed are display panel and display device. The display panel includes plurality of pixel repetitive units arranged in array. Each pixel repetitive unit includes two first sub-pixels, two second sub-pixels and four third sub-pixels, and light emitting colors of two first sub-pixels, two second sub-pixels and four third sub-pixels are different. For each pixel repetitive unit, centers of four third sub-pixels constitute first virtual square, one first sub-pixel located inside the first virtual square, and center of the first virtual square doesn't overlap center of one first sub-pixel located inside the first virtual square; and centers of two first sub-pixels and centers of two second sub-pixels constitute first virtual parallelogram, and one third sub-pixel located inside the first virtual parallelogram. The arrangement of the third sub-pixels can reduce display serrated sense of vertical line array and improve display effect of vertical line, thereby improving display effect of display panel.

17 Claims, 9 Drawing Sheets

DISPLAY PANEL AND DISPLAY DEVICE

CROSS-REFERENCE TO RELATED APPLICATION(S)

This application claims priority to Chinese Patent Application No. 202110633264.0 filed Jun. 7, 2021, titled "DISPLAY PANEL AND DISPLAY DEVICE", the disclosure of which is incorporated herein by reference in its entirety.

TECHNICAL FIELD

Embodiments of the present disclosure relate to the field of display technologies and, in particular, to a display panel and a display device.

BACKGROUND

With the progress and development of science and technology and the improvement of people's standard of living, the display panel has been deeply used in various electronic products. Hence the display panels are manufactured in large quantity, and people have higher and higher requirements for the performance of the display panels.

The display panel includes a plurality of pixel units. The pixel unit includes a plurality of sub-pixels having different light emitting colors. When the display panel displays an image, each sub-pixel in the pixel unit emits light having different brightness, and the light having different brightness is mixed into a desired color visually by human eyes.

However, the display effect cannot be optimized by a pixel arrangement structure of an existing display panel.

SUMMARY

Embodiments of the present disclosure provide a display panel and a display device to improve the display effect.

A display panel is provided in embodiments of the present disclosure and includes a plurality of pixel repetitive units arranged in array, where each pixel repetitive unit of the plurality of pixel repetitive units includes two first sub-pixels, two second sub-pixels and four third sub-pixels, and a light emitting color of the two first sub-pixels, a light emitting color of the two second sub-pixels and a light emitting color of the four third sub-pixels are different.

For each pixel repetitive unit, centers of the four third sub-pixels constitute a first virtual square, one first sub-pixel of the two first sub-pixels is located inside the first virtual square, and a center of the first virtual square does not overlap a center of the one first sub-pixel located inside the first virtual square.

Centers of the two first sub-pixels and centers of the two second sub-pixels constitute a first virtual parallelogram, and one third sub-pixel of the four third sub-pixels is located inside the first virtual parallelogram.

Based on a same inventive concept, embodiments of the present disclosure further provide a display device. The display device includes the preceding display panel.

In embodiments of the present disclosure, for each pixel repetitive unit, pixels are arranged to form two virtual shapes including a virtual parallelogram formed by two first sub-pixels and two second sub-pixels, and a virtual square formed by four third sub-pixels, where one third sub-pixel of the four third sub-pixels is located inside the virtual parallelogram and the other three third sub-pixels of the four third sub-pixels are located outside the virtual parallelogram. Centers of the four third sub-pixels in each pixel repetitive unit constitute a virtual square, which facilitates a uniform arrangement of the third sub-pixels in the display panel, and also facilitates an array arrangement of the third sub-pixels in the display panel. Centers of the third sub-pixels arranged in a column direction are located on a same vertical line, so that a display serrated sense of a vertical line array can be reduced based on the arrangement of the third sub-pixels, and a display effect of the vertical line array can be improved, thereby improving the display effect of the display panel.

BRIEF DESCRIPTION OF DRAWINGS

In order that embodiments of the present disclosure or the related art are described more clearly, drawings to be used in the description of the embodiments or the related art are briefly described hereinafter. Apparently, while the drawings in the description are some embodiments of the present disclosure, these drawings may be expanded and extended to other structures and drawings according to the basic concepts disclosed and taught in embodiments of the present disclosure, which are undoubtedly all within the scope of the claims of the present disclosure.

DETAILED DESCRIPTION

Embodiments of the present disclosure are hereinafter described with reference to drawings of embodiments of the present disclosure and in conjunction with implementations. Apparently, the embodiments described herein are some embodiments, not all embodiments, of the present disclosure.

Figure 1:
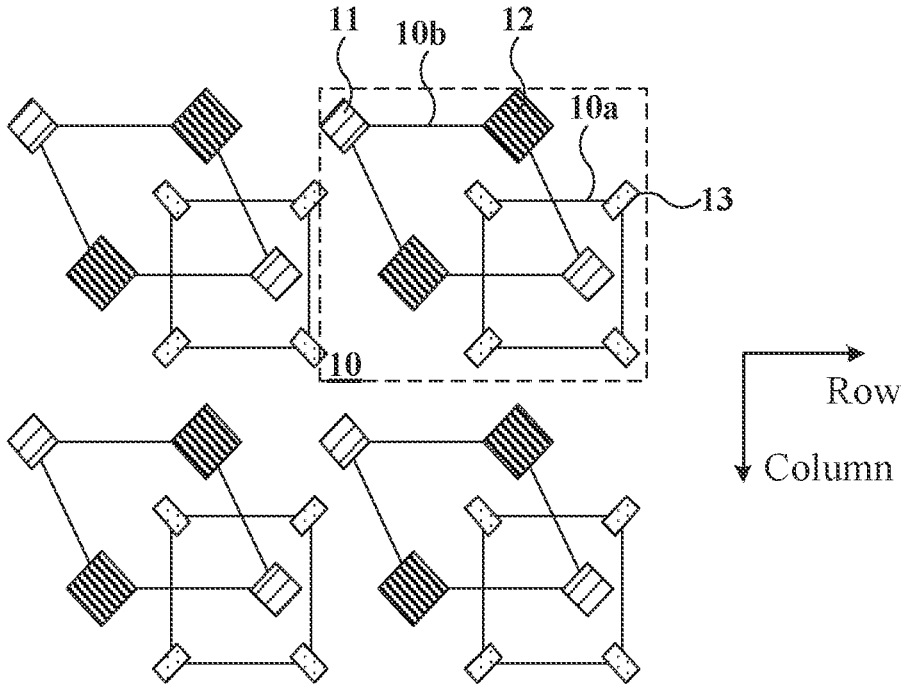
FIG. 1 is a schematic diagram of a display panel according to an embodiment of the present disclosure.
Figure 2:
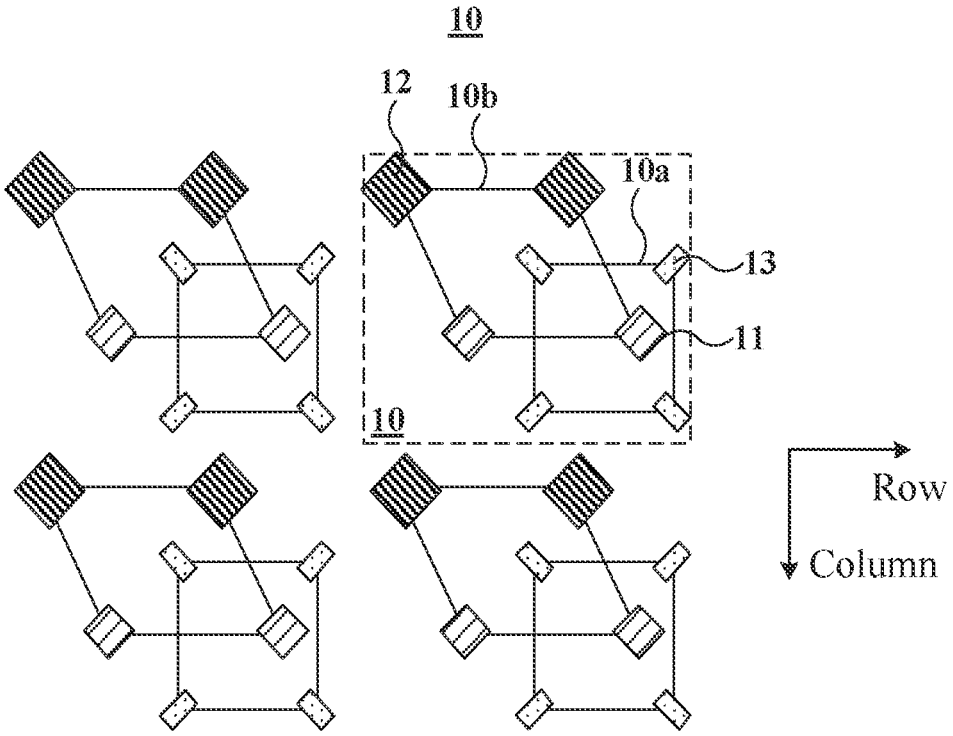
FIG. 2 is a schematic diagram of a display panel according to another embodiment of the present disclosure.
Figure 3:
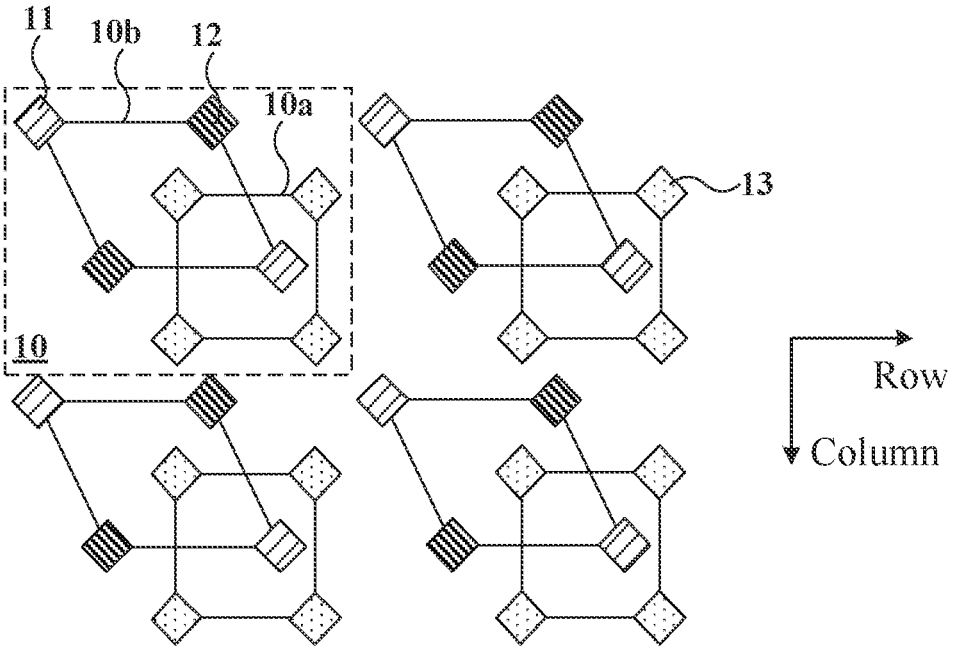
FIG. 3 is a schematic diagram of a display panel according to another embodiment of the present disclosure.

FIG. 1 is a schematic diagram of a display panel according to an embodiment of the present disclosure, FIG. 2 is a schematic diagram of a display panel according to another embodiment of the present disclosure, and FIG. 3 is a schematic diagram of a display panel according to another embodiment of the present disclosure. The display panel provided in the present embodiment includes a plurality of pixel repetitive units 10 arranged in array. Each pixel repetitive unit 10 includes two first sub-pixels 11, two second sub-pixels 12 and four third sub-pixels 13. A light emitting color of the two first sub-pixels 11, a light emitting color of the two second sub-pixels 12, and a light emitting color of the four third sub-pixels 13 are different. For each pixel repetitive unit 10, centers of the four third sub-pixels 13 constitute a first virtual square 10*a*, one first sub-pixel 11 is located inside the first virtual square 10*a*, and a center of the first virtual square 10*a* does not overlap a center of the one first sub-pixel 11 located inside the first virtual square 10*a*; and centers of the two first sub-pixels 11 and centers of the two second sub-pixels 12 constitute a first virtual parallelogram 10*b*, and one third sub-pixel 13 of the four third sub-pixels 13 is located inside the first virtual parallelogram 10*b*.

In the present embodiment, the display panel includes a plurality of pixel repetitive units 10, and the plurality of pixel repetitive units 10 are arranged in array along a row direction and a column direction. The pixel repetitive units 10 are translated in the row direction to obtain a row of pixel repetitive units 10, the pixel repetitive units 10 are translated in the column direction to obtain a column of pixel repetitive units 10.

One pixel repetitive unit 10 includes eight sub-pixels, which are two first sub-pixels 11, two second sub-pixels 12 and four third sub-pixels 13 respectively. A light emitting color of the two first sub-pixels 11, a light emitting color of the two second sub-pixels 12 and a light emitting color of the four third sub-pixels 13 are different. In an embodiment, the two first sub-pixels 11, the two second sub-pixels 12 and the four third sub-pixels 13 emit red light R, green light G and blue light B, respectively. For example, the two first sub-pixels 11 emit red light R, the two second sub-pixels 12 emit green light G and the four third sub-pixels 13 emit blue light B. In other embodiments, the light emitting colors of the two first sub-pixels, the two second sub-pixels, and the four third sub-pixels may be in an order of B, R, G, or in other order, which is not limited thereto.

A sub-pixel includes a light-emitting structure and a driver circuit. The sub-pixel may be divided into a light-emitting region and a non-light-emitting region according to whether light is emitted or not thereover. The light-emitting structure for emitting light is distributed in the light-emitting region, and the driver circuit for driving the light-emitting structure to emit light is distributed in the non-light-emitting region. A center of the sub-pixel in this embodiment may be understood as a center point of a light-emitting region of the sub-pixel. It can be understood that a shape of the light-emitting region of the sub-pixel may be either a regular shape or an irregular shape, and the center of the sub-pixel is a geometric center of the shape of the light-emitting region of the sub-pixel. The sub-pixels shown in FIGS. 1 to 3 are essentially light-emitting regions of the sub-pixels. Gaps between light-emitting regions of adjacent sub-pixels are non-light emitting regions of the sub-pixels, and the non-light-emitting regions are used for placing structures such as driving circuits of the sub-pixels and the like. The center of the sub-pixel below refers to a geometric center of a shape of a light-emitting region of the sub-pixel, and the sub-pixel shown in the following figures are the light-emitting region of the sub-pixel.

In the present embodiment, in a pixel repetitive unit 10, centers of four third sub-pixels 13 constitute a first virtual square 10*a*. The first virtual square 10*a* includes four vertexes, and each vertex coincides with a center of a light-emitting region of a respective sub-pixel of the four third sub-pixels. Centers of the four third sub-pixels 13 in a pixel repetitive unit 10 constitute a first virtual square 10*a*, so that the third sub-pixels 13 are arranged in such a manner which facilitates the third sub-pixels 13 to be uniformly arranged in the display panel. In addition, as the pixel repetitive units 10 in the display panel are arranged in array, and centers of the four third sub-pixels 13 in a pixel repetitive unit 10 constitute a virtual square, the plurality of third sub-pixels 13 in the display panel are arranged in array. Centers of the third sub-pixels 13 arranged in a row direction or in a column direction are located in a same straight line, so that a display serrated sense of a vertical line array of the third sub-pixels 13 can be reduced, thereby improving the display effect of the display panel.

A first sub-pixel 11 is located inside the first virtual square 10*a*, a center of the first virtual square 10*a* does not overlap a center of the one first sub-pixel 11 located inside the first virtual square 10*a*, and the center of the first virtual square 10*a* is an intersection point of two diagonal lines of the first virtual square 10*a*. In a case where the center of the first virtual square 10*a* does not overlap the center of the one first sub-pixel 11 located inside the first virtual square 10*a*, when the pixels are arranged, a shape and an area of the one first sub-pixel 11 located inside the first virtual square 10*a* can be rationally designed, so that a size of the light-emitting region of the first sub-pixels 11 and a spacing between the first sub-pixels 11 and other sub-pixels can be adjusted, and it is also possible to flexibly adjust a length of a side of the first virtual square 10*a* (i.e., a spacing between adjacent third sub-pixels 13) and other parameters, to rationally design the spacing between sub-pixels having different light-emitting colors and the like, thereby achieving a pixel arrangement satisfying different resolutions or display effect.

In the present embodiment, in a pixel repetitive unit 10, centers of two first sub-pixels 11 and centers of two second sub-pixels 12 constitute a first virtual parallelogram 10*b*. The first virtual parallelogram 10*b* includes four vertexes, and each vertex coincides with a center of a light-emitting region of a respective sub-pixel. The first virtual parallelogram 10*b* includes four edges, two opposite sides are parallel to each other, and lengths of two adjacent sides are usually different, so that a spacing between the first sub-pixel 11 and the second sub-pixel 12 is relatively large, thereby relieving the light-stealing problem of sub-pixels.

Referring to FIG. 1, two opposite vertexes of the first virtual parallelogram 10*b* are disposed with two same first sub-pixels 11, and the remaining two opposite vertexes of the first virtual parallelogram 10*b* are disposed with two same second sub-pixels 12, that is, two adjacent vertexes of the first virtual parallelogram 10*b* are disposed with two sub-pixels with different light-emitting colors. In one embodiment, referring to FIG. 2, two adjacent vertexes of the first virtual parallelogram 10*b* are disposed with two same first sub-pixels 11, and the remaining two adjacent vertexes of the first virtual parallelogram 10*b* are disposed with two same second sub-pixels 12. Relevant practitioners can rationally design placement positions of the first sub-pixels and the second sub-pixels on the four vertexes of the first virtual parallelogram according to product requirements. No limitation is made to the above illustration.

In a pixel repetitive unit 10, one third sub-pixel 13 is located inside the first virtual parallelogram 10*b*, and the remaining three third sub-pixels 13 are located outside the first virtual parallelogram 10*b*. When the one third sub-pixel 13 is disposed inside the first virtual parallelogram 10*b*, a distance between a third sub-pixel 13 and a first sub-pixel 11 and a distance between a third sub-pixel 13 and a second sub-pixel 12 are rationally designed, which is beneficial to color mixing of light having different colors, thereby reducing the probability of color cast phenomenon in the pixel repetitive units 10, and improving the display effect of the display panel.

It can be understood that, a process differential is allowed in actual manufacturing, that is, the vertexes of the virtual shape can be allowed to have a differential with the centers of the sub-pixels corresponding to the vertexes, which does not require a complete coincidence therebetween, and a small differential or spacing therebetween may exist. Within an allowable differential range, the vertexes of the virtual shape can be regarded as coincident with the centers of the light-emitting region of the sub-pixels corresponding to the vertexes.

It is to be noted that a shape or an area of each first sub-pixel 11, a shape or an area of each second sub-pixel 12 and a shape or an area of each third sub-pixel 13 shown in FIGS. 1 to 3 may be same or different, and the shapes thereof are not limited to the illustrations, but may also be other shape such as a pentagon, a hexagon, a square, a circle, and etc. The relevant practitioners may rationally design according to the requirements of the product, but no limitation is made to this.

In the embodiment of the present disclosure, for each pixel repetitive unit, pixels are arranged to form two virtual shapes including a virtual parallelogram formed by two first sub-pixels and two second sub-pixels, and a virtual square formed by four third sub-pixels, where one third sub-pixel of the four third sub-pixels is located inside the virtual parallelogram and the other three third sub-pixels of the four third sub-pixels are located outside the virtual parallelogram. Centers of the four third sub-pixels in each pixel repetitive unit constitute a virtual square, which facilitates the uniform arrangement of the third sub-pixels in the display panel, and also facilitates the array arrangement of the third sub-pixels in the display panel. Centers of the third sub-pixels arranged in a column direction are located on a same vertical line, so that a display serrated sense of a vertical line array can be reduced based on the arrangement of the third sub-pixels, and a display effect of the vertical line array can be improved, thereby improving the display effect of the display panel.

In an embodiment, the center of the first virtual parallelogram 10*b* does not overlap the center of the one third sub-pixel 13 located inside the first virtual parallelogram 10*b*. The center of the first virtual parallelogram 10*b* is an intersection point of two diagonal lines of the first virtual parallelogram 10*b*. When the center of the first virtual parallelogram 10*b* does not overlap the center of the one third sub-pixel 13 located inside the first virtual parallelogram 10*b*, and the pixels are arranged, a shape and an area of the one third sub-pixel 13 located inside the first virtual parallelogram 10*b* may be rationally designed so that a size of the light-emitting region of the third sub-pixels 13 and a spacing between the third sub-pixels 11 and other sub-pixels can be adjusted; and it is also possible to flexibly adjust a length of a side of the first virtual parallelogram 10*b*, to adjust the spacing between sub-pixels having different light-emitting colors and the like, thereby achieving the pixel arrangement satisfying different resolutions or display effect.

Figure 4:
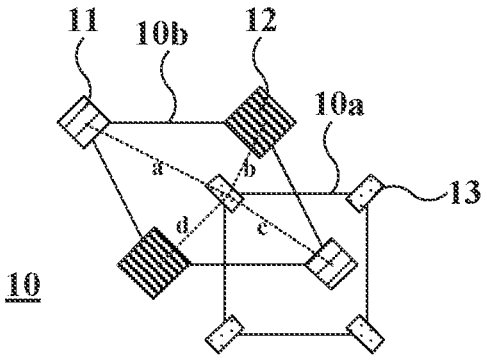
FIG. 4 is a schematic diagram of a pixel repetitive unit according to an embodiment of the present disclosure.
Figure 5:
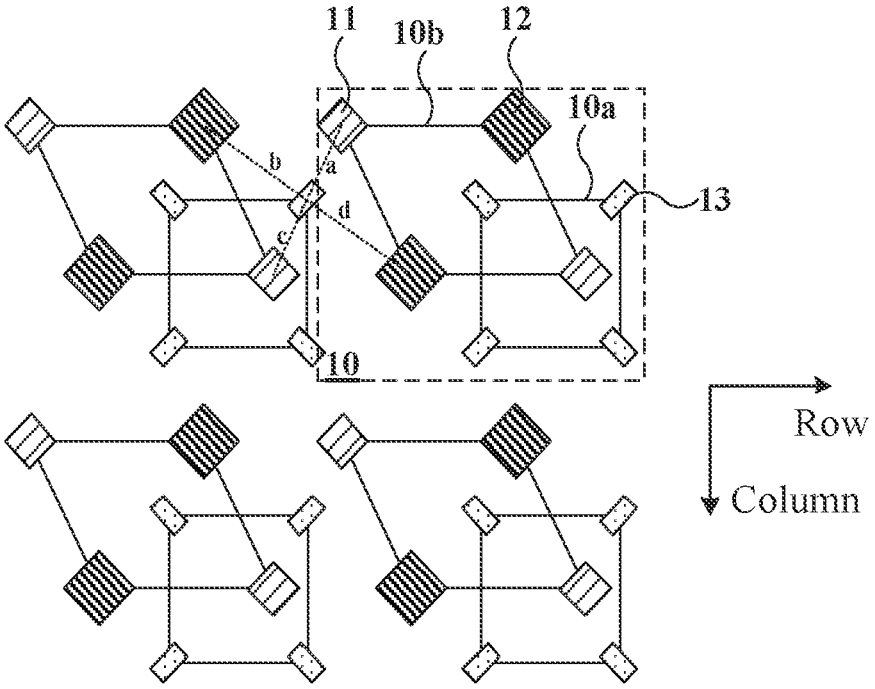
FIG. 5 is a schematic diagram of a display panel according to another embodiment of the present disclosure.
Figure 6:
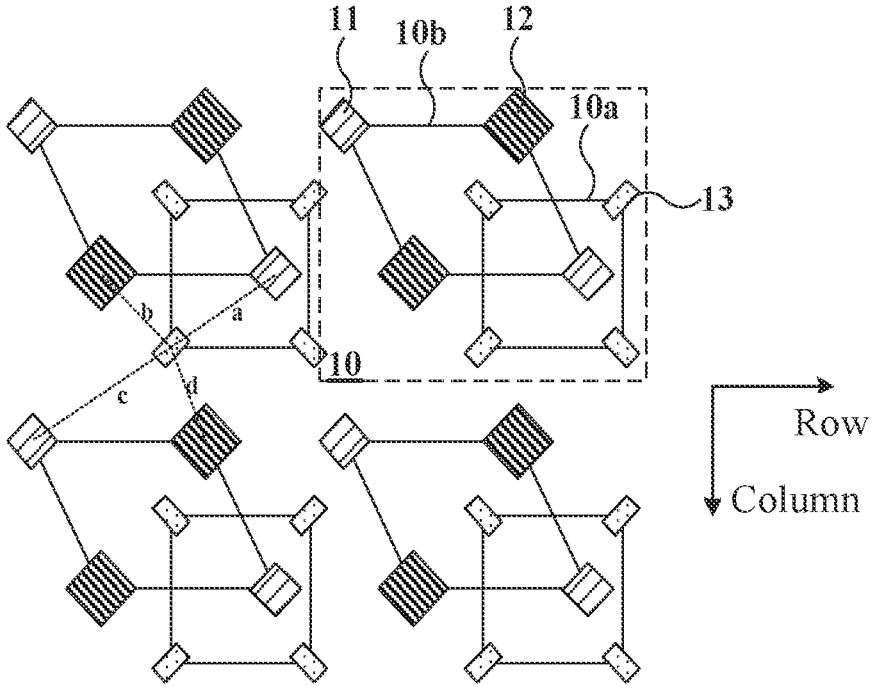
FIG. 6 is a schematic diagram of a display panel according to another embodiment of the present disclosure.

FIG. 4 is a schematic diagram of a pixel repetitive unit according to an embodiment of the present disclosure; FIG. 5 is a schematic diagram of a display panel according to another embodiment of the present disclosure; and FIG. 6 is a schematic diagram of a display panel according to another embodiment of the present disclosure. In an embodiment, a spacing a is provided between a center of each third sub-pixel 13 of the four third sub-pixels and a center of one first sub-pixel 11 of the two first sub-pixels 11 adjacent to the each third sub-pixel 13, and a spacing c is provided between the center of the each third sub-pixel 13 and a center of an other first sub-pixel 11 of the two first sub-pixels 11 adjacent to the each third sub-pixel 13; and a spacing b is provided between a center of the each third sub-pixel 13 and a center of one second sub-pixel 12 of the two second sub-pixels 12 adjacent to the each third sub-pixel 13, and a spacing d is provided between the center of the each third sub-pixel 13 and a center of an other second sub-pixel 12 of the two second sub-pixels 12 adjacent to the each third sub-pixel 13, where $a \neq b \neq c \neq d$ or $a = b \neq c \neq d$ or $a = d \neq c \neq b$.

As shown in FIG. 4, a, b, c, and d are used for representing spacings between a third sub-pixel 13 located inside the first virtual parallelogram 10*b* and four sub-pixels located at four vertexes of the first virtual parallelogram 10*b* in the pixel repetitive unit 10. Each spacing refers to a spacing between geometric centers of the light emitting regions of the two sub-pixels. When the center of the first virtual parallelogram 10*b* does not overlap the center of the one third sub-pixel 13, $a \neq c$, and $b \neq d$; on the basic thereto, $a \neq b \neq c \neq d$, $a = b$, or, $a = d$.

As shown in FIG. 5, in two adjacent pixel repetitive units 10 along the row direction, one third sub-pixel 13 is located between two adjacent first virtual parallelograms 10*b* in the row direction, the two adjacent first virtual parallelograms 10*b* have two opposite sides, and the two opposite sides include two first sub-pixels 11 and two second sub-pixels 12. a is used for representing a spacing between the one third sub-pixel 13 and one first sub-pixel 11 of two first sub-pixels 11 on a side of two opposite sides in the row direction, c is used for representing a spacing between the one third sub-pixel 13 and the other first sub-pixel 11 of the two first sub-pixels 11 on the other side of two opposite sides in the row direction, b is used for representing a spacing between the one third sub-pixel 13 and one second sub-pixel 12 of two second sub-pixels 12 on the side of the two opposite sides in the row direction, and d is used for representing a spacing between the one third sub-pixel 13 and the other second sub-pixel 12 of the two second sub-pixels 12 on the other side of the two opposite sides in the row direction. In an embodiment, $a \neq b \neq c \neq d$, $a = b \neq c \neq d$, or, $a = d \neq c \neq b$.

As shown in FIG. 6, in two adjacent pixel repetitive units 10 along the column direction, one third sub-pixel 13 is located between two adjacent first virtual parallelograms 10*b* in the column direction, the two adjacent first virtual parallelograms 10*b* have two opposite sides, and the two opposite sides include two first sub-pixels 11 and two second sub-pixels 12. a is used for representing a spacing between the one third sub-pixel 13 and one first sub-pixel 11 of two first sub-pixels 11 on a side of two opposite sides in the column direction, c is used for representing a spacing between the one third sub-pixel 13 and the other first sub-pixel 11 of the two first sub-pixels 11 on the other side of two opposite sides in the column direction, b is used for representing a spacing between the one third sub-pixel 13 and one second sub-pixel 12 of two second sub-pixels 12 on the side of the two opposite sides in the column direction, and d is used for representing a spacing between the one third sub-pixel 13 and the other second sub-pixel 12 of the two second sub-pixels 12 on the other side of the two opposite sides in the column direction. In an embodiment, a≠b≠c≠d, a=b≠c≠d, or, a=d≠c≠b.

By using such a pixel arrangement, a spacing between the sub-pixels having different light-emitting colors can be flexibly adjusted, thereby reducing the light-stealing risk of pixels, reducing a display serrated sense of a vertical line and improving the display effect. It can be understood that the above pixel arrangement is only a partial example and no limitation is made thereto.

Figure 7:
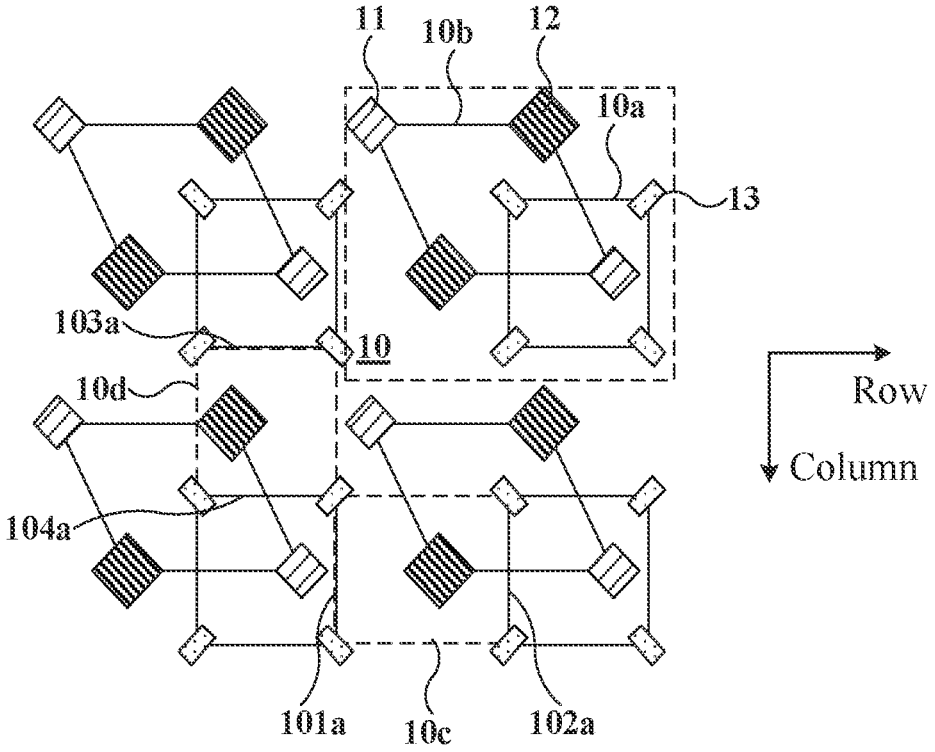
FIG. 7 is a schematic diagram of a display panel according to another embodiment of the present disclosure.

With reference to FIG. 7, FIG. 7 is a schematic diagram of a display panel according to another embodiment of the present disclosure. As shown in FIG. 7, centers of two third sub-pixels 13 on a side of one first virtual square 10*a* of two adjacent first virtual squares 10*a* and centers of four third sub-pixels 13 on two opposite sides of two adjacent first virtual squares 10*a* constitute a first virtual rectangle, and one second sub-pixel 12 of the two second sub-pixels 12 is located inside the first virtual rectangle.

In the row direction, each of two adjacent first virtual squares 10*a* are located in a respective one of two adjacent pixel repetitive units 10, and the two adjacent first virtual squares 10*a* do not share an edge. For the two adjacent first virtual squares 10*a*, in the row direction from left to right as illustrated, when one first virtual square 10*a* at the left side has one side 101*a*, the side 101*a* faces a first virtual square 10*a* at the right side adjacent to the one first virtual square 10*a* at the left side, one first virtual square 10*a* at the right side has one side 102*a*, and the side 102*a* faces a first virtual square 10*a* at the left side adjacent to the one first virtual square 10*a* at the right side, the one side 101*a* and the one side 102*a* each is one side of two opposite sides of the two adjacent first virtual squares 10*a*. The one side 101*a* and the one side 102*a* are parallel to each other. Centers of two third sub-pixels 13 of four third sub-pixels 13 located on the one side 101*a* and centers of the other two third sub-pixels 13 of the four third sub-pixels 13 located on the one side 102*a* constitute a first virtual rectangle 10*c*, where one second sub-pixel 12 is located inside the first virtual rectangle 10*c*.

In the column direction, two adjacent first virtual squares 10*a* are located in two adjacent pixel repetitive units 10, and the two adjacent first virtual squares 10*a* do not share an edge. For the two adjacent first virtual squares 10*a*, in the column direction from up to down as illustrated, when one first virtual square 10*a* at the upside has one side 103*a*, the side 103*a* faces a first virtual square 10*a* at the downside adjacent to the one first virtual square 10*a* at the upside, one first virtual square 10*a* at the downside has one side 104*a*, and the side 103*a* faces a first virtual square 10*a* at the upside adjacent to the one first virtual square 10*a* at the downside, the one side 103*a* and the one side 104*a* each is one side of two opposite sides of the two adjacent first virtual squares 10*a*. The one side 103*a* and the one side 104*a* are parallel to each other. Centers of two third sub-pixels 13 of four third sub-pixels 13 located on the one side 103*a* and centers of the other two third sub-pixels 13 of the four third sub-pixels 13 located on the one side 104*a* constitute a first virtual rectangle 10*d*, where one second sub-pixel 12 is located inside the first virtual rectangle 10*d*.

As can be seen from FIG. 7, when the third sub-pixels are arranged in the above pixel arrangement manner, geometric centers of the light-emitting regions of the third sub-pixels 13 arranged in the column direction can be located at a same vertical line, so that the third sub-pixels 13 can achieve good vertical line array display effect, reduce a display serrated sense of a vertical line array, and improve the display effect.

In an embodiment, a center of the first virtual rectangle does not overlap a center of one second sub-pixel 12 located inside the first virtual rectangle. The center of the first virtual rectangle 10*c*/10*d* is an intersection point of two diagonal lines of the first virtual rectangle 10*c*/10*d*. When the center of the first virtual rectangle 10*c*/10*d* does not overlap the center of the one second sub-pixel 12 located inside the first virtual rectangle 10*c*/10*d*, and the pixels are arranged, a shape and an area of the one second sub-pixel located inside the first virtual rectangle may be rationally designed so that a size of the light-emitting region of the second sub-pixels and a spacing between the second sub-pixels and other sub-pixels can be adjusted; and it is also possible to flexibly adjust a length of sides of the first virtual rectangle, to adjust the spacing between sub-pixels having different light-emitting colors and the like, thereby achieving the pixel arrangement satisfying different resolutions or display effect and reducing the light-stealing risk of sub-pixels.

In an embodiment, an area of the first virtual rectangle is the same as an area of the first virtual square 10*a*.

Referring to FIG. 7, in the row direction, the area of the first virtual rectangle 10*c* is the same as the area of the first virtual square 10*a*, that is, the centers of four third sub-pixels 13 in the pixel repetitive unit 10 form the first virtual square 10*a*. Centers of four third sub-pixels 13 on two opposite sides of two adjacent first virtual squares 10*a* constitute a same virtual square. In the row direction, the spacing between each two adjacent third sub-pixels 13 is equal, thereby achieving the uniform distribution of the third sub-pixels 13 in the row direction, and improving the display effect.

Referring to FIG. 7, in the column direction, the area of the first virtual rectangle 10*d* is same as the area of the first virtual square 10*a*, that is, the centers of four third sub-pixels 13 in the pixel repetitive unit 10 form the first virtual square 10*a*, and centers of two third sub-pixels 13 on a side of one first virtual square 10*a* of two adjacent first virtual squares 10*a* and centers of four third sub-pixels 13 on two opposite sides of the two adjacent first virtual squares 10*a* constitute a same virtual square. In the column direction, the spacing between each two adjacent third sub-pixels 13 is equal, which achieves the uniform distribution of the third sub-pixels 13 in the column direction, and improves the display effect.

In other embodiments, a length of a side of the first virtual parallelogram is equal to a length of a side of the first virtual square, or lengths of sides of the first virtual parallelogram are equal each other, or a length of each side of the first virtual parallelogram is equal to a length of a side of the first virtual square. Relevant practitioners can rationally design parameters such as the lengths of the sides of the first virtual parallelogram and the length of the side of the first virtual square according to the product requirements, and the pixel arrangement mode includes but is not limited to the above examples.

Figure 8:
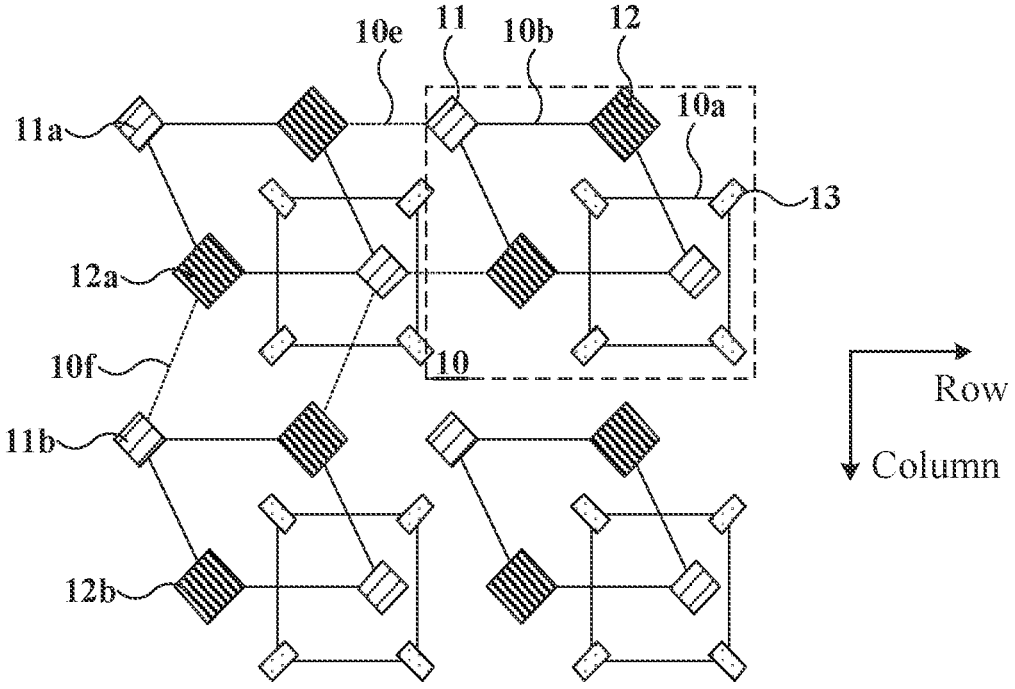
FIG. 8 is a schematic diagram of a display panel according to another embodiment of the present disclosure.

With reference to FIG. 8, FIG. 8 is a schematic diagram of a display panel according to another embodiment of the present disclosure. As shown in FIG. 8, centers of two first sub-pixel 11 and centers of two second sub-pixel 12 on two opposite sides of two adjacent first virtual parallelograms 10*b* constitute a second virtual parallelogram, and one third sub-pixel 13 of the four third sub-pixels is located inside the second virtual parallelogram.

In the row direction, each of two adjacent first virtual parallelograms 10*b* are located in a respective one of two adjacent pixel repetitive units 10, and the two adjacent first virtual parallelograms 10*b* do not share an edge. For the two adjacent first virtual parallelograms 10*b*, each side of the first virtual parallelogram 10*b* opposite to the other first virtual parallelogram 10*b* is one of two opposite sides of the two adjacent first virtual parallelograms 10*b*. The two opposite sides are parallel to each other. Centers of two first sub-pixels 11 and centers of two second sub-pixels 12 on the two opposite sides constitute a second virtual parallelogram 10*e*, and one third sub-pixel 13 of the four third sub-pixels 13 is located inside the second virtual parallelogram 10*e*.

Similarly, in the column direction, centers of two first sub-pixels 11 and centers of two second sub-pixels 12 on opposite sides of two adjacent first virtual parallelograms 10*b* constitute a second virtual parallelogram 10*f*, and one third sub-pixel 13 of the four third sub-pixels 13 is located inside the second virtual parallelogram 10*f*.

As can be seen from FIG. 8, when the first sub-pixels 11 and the second sub-pixels 12 are arranged in the above pixel arrangement mode, the spacing between the first sub-pixel 11 and the second sub-pixel 12 may be made relatively large, so that there is less contact between the first sub-pixel 11 and the second sub-pixel 12, thereby relieving the light-stealing problem of the first sub-pixel 11 and the second sub-pixel 12.

In an embodiment, the center of the second virtual parallelogram does not overlap the center of the one third sub-pixel 13 located inside the second virtual parallelogram. The center of the second virtual parallelogram is an intersection point of two diagonal lines of the second virtual parallelogram. When the center of the second virtual parallelogram does not overlap the center of the one third sub-pixel 13 located inside the second virtual parallelogram, and the pixels are arranged, a shape and an area of the first sub-pixels 11, a shape and an area of the second sub-pixels 12 and a shape and an area of the third sub-pixels 13 may be rationally designed so that a size of the light-emitting region of the sub-pixels having different light-emitting colors and a spacing between the sub-pixels having different light-emitting colors can be adjusted, thereby improving the display effect and reducing the light-stealing risk of sub-pixels.

In an embodiment, in one column of pixel repetitive units 10, a plurality of first sub-pixels 11 each located at a same position of a respective pixel repetitive unit 10 of the one column of pixel repetitive units 10 are located on a same straight line, and a plurality of second sub-pixels 12 each located at a same position of a respective pixel repetitive unit 10 of the one column of pixel repetitive units 10 are located on a same straight line.

In the present embodiment, the one column of pixel repetitive units 10 include a plurality of pixel repetitive units 10. When one pixel repetitive unit 10 of the one column of pixel repetitive units 10 is translated in the column direction, the one pixel repetitive unit 10 after translated overlaps another pixel repetitive unit 10, and the first sub-pixels 11 overlapped and located at the two overlapped pixel repetitive units 10 are the first sub-pixels 11 at a same position. Similarly, the second sub-pixels 11 overlapped and located at the two overlapped pixel repetitive units 10 are the second sub-pixels 11 at a same position.

For example, after a pixel repetitive unit 10 including a first sub-pixel 11*a* is translated in the column direction, the pixel repetitive unit 10 including the first sub-pixel 11*a* may overlap a pixel repetitive unit 10 including a first sub-pixel 11*b*. In a case where the first sub-pixel 11*a* and the first sub-pixel 11*b* are both located at a same position of the overlapped respective pixel repetitive units 10, the first sub-pixel 11*a* and the first sub-pixel 11*b* each is located at a same position of a respective pixel repetitive unit 10 of one column of pixel repetitive units 10. Similarly, a second sub-pixel 12*a* and a second sub-pixel 12*b* each is located at a same position of a respective pixel repetitive unit 10 of one column of pixel repetitive units 10.

In the one column of pixel repetitive units 10, when the first sub-pixel 11*a*, the first sub-pixel 11*b* and other first sub-pixels 11 each located at a same position of a respective pixel repetitive unit 10 of the one column of pixel repetitive units 10 are located on a same straight line, the serrated sense of the first sub-pixels 11 in the one column of pixel repetitive units 10 can be reduced; and when the second sub-pixel 12*a*, the second sub-pixel 12*b* and other second sub-pixels 12 each located at a same position of a respective pixel repetitive unit 10 of the one column of pixel repetitive units 10 are located on a same straight line, the display serrated sense of the second sub-pixels 12 in the one column of pixel repetitive units 10 can be reduced, whereby the display effect is improved.

In an embodiment, along the column direction, the first virtual parallelogram 10*b* and the second virtual parallelogram 10*f* adjacent to each other, are distributed axisymmetrically along a common side of the first virtual parallelogram and the second virtual parallelogram. In the present embodiment, the first virtual parallelogram 10*b* and the second virtual parallelogram 10*f* adjacent to each other have a common side. When the first virtual parallelogram 10*b* and the second virtual parallelogram 10*f* are designed to be distributed axisymmetrically along the common side, an area of the first virtual parallelogram 10*b* is same as an area of the second virtual parallelogram 10*f*. In a case where this pixel arrangement mode is adopted, in the column direction, the first sub-pixels 11 and the second sub-pixels 12 are regularly distributed, so that the display serrated sense of the first sub-pixels 11 and the second sub-pixels 12 in the column direction can be reduced, and the display effect can be improved.

Figure 9:
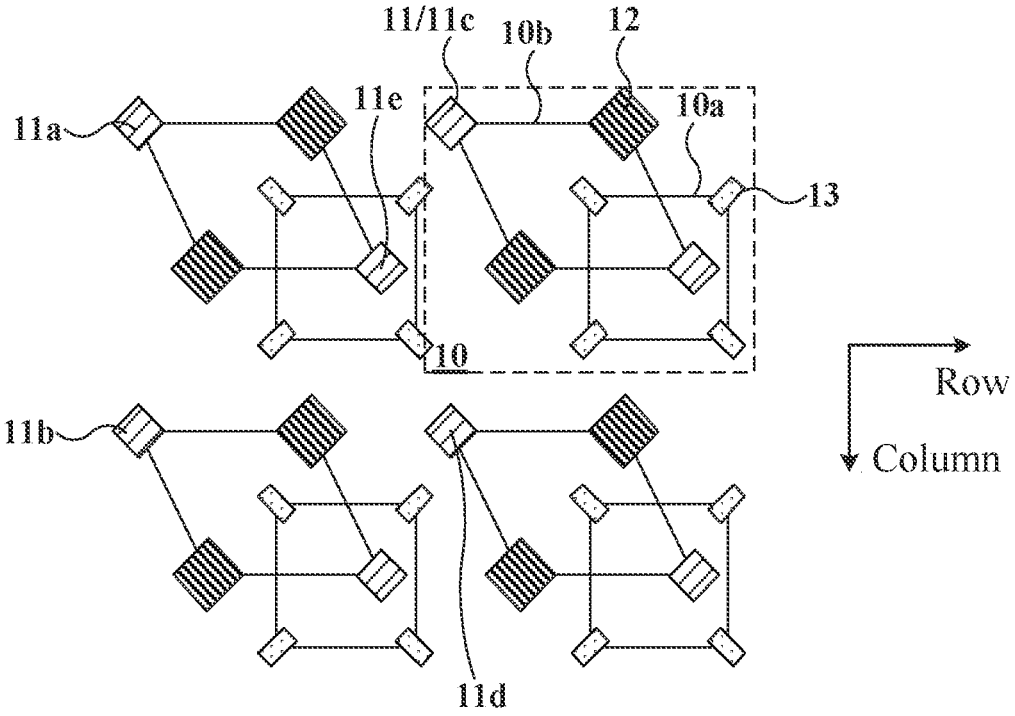
FIG. 9 is a schematic diagram of a display panel according to another embodiment of the present disclosure.
Figure 10:
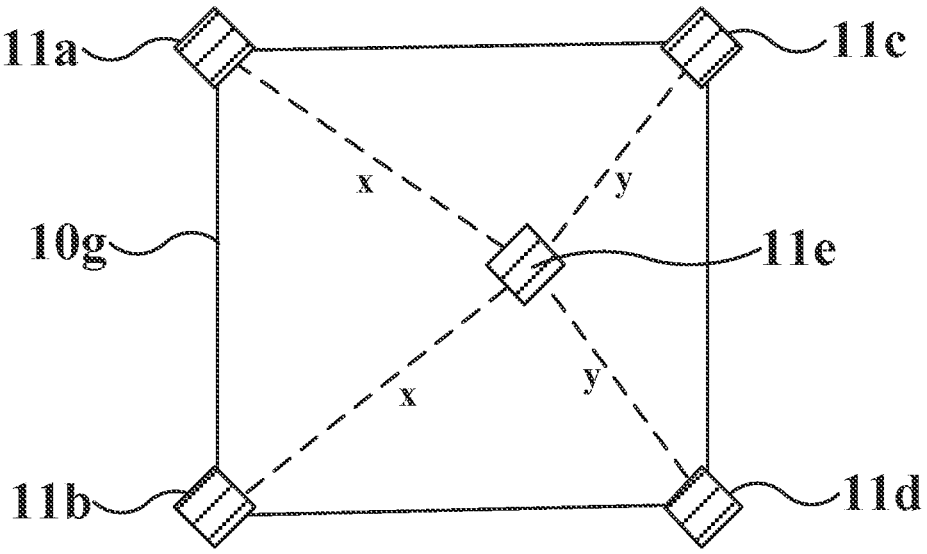
FIG. 10 is a partial schematic diagram of FIG. 9.

Referring to FIG. 9, FIG. 9 is a schematic diagram of a display panel according to another embodiment of the present disclosure, and FIG. 10 is a partial schematic diagram of FIG. 9. As shown in FIGS. 9 and 10, in four adjacent pixel repetitive units 10, centers of four first sub-pixels 11 each located at a same position of a respective pixel repetitive unit 10 of the four adjacent pixel repetitive units 10 constitute a first virtual quadrangle 10*g*, a first sub-pixel 11 of a pixel repetitive unit 10 of the four adjacent pixel repetitive units 10 is located inside the first virtual quadrangle 10*g*, and has a center not overlapping the a center of the first virtual quadrangle 10*g*.

In the present embodiment, four pixel repetitive units 10 arranged in a 2×2 matrix are selected, and each two of the four pixel repetitive units 10 are arranged adjacent to each other. For the four pixel repetitive units 10, it can be understood that when a pixel repetitive unit 10 of the four pixel repetitive units 10 is translated along the row direction, two pixel repetitive units 10 in the row direction overlap; and when a pixel repetitive unit 10 of the four pixel repetitive units 10 is translated along the column direction, two pixel repetitive units 10 in the column direction overlap. The first sub-pixels 11 after being overlapped located at a same position of a respective pixel repetitive unit of the four pixel repetitive units 10 are the first sub-pixels 11 having the same position.

In four adjacent pixel repetitive units 10, four first sub-pixels 11 each located at a same position of a respective pixel repetitive unit 10 of the four pixel repetitive units 10 are a first sub-pixel 11*a*, a first sub-pixel 11*b*, a first sub-pixel 11*c* and a first sub-pixel 11*d*, respectively. The centers of the four first sub-pixels 11 each located at a same position of a respective pixel repetitive unit 10 of the four adjacent pixel repetitive units 10 constitute the first virtual quadrangle 10*g*, a first sub-pixel 11*e* of a pixel repetitive unit 10 of the four adjacent pixel repetitive units 10 is located inside the first virtual quadrangle 10*g*, and has a center not overlapping the center of the first virtual quadrangle 10*g*. It can be understood that a plurality of sub-pixels are included inside the first virtual quadrangle 10*g*, but only one first sub-pixel 11*e* exists among the plurality of sub-pixels, and the other sub-pixels are second sub-pixels 12 and third sub-pixels 13.

When the center of the first virtual quadrangle 10*g* is an intersection point of two diagonal lines of the first virtual quadrangle 10*g*, and the center of the first virtual quadrangle 10*g* does not overlap a center of the first sub-pixel 11*e*, a spacing between the first sub-pixels can be flexibly designed to achieve better display effect.

In an embodiment, the first virtual quadrangle 10*g* includes two adjacent sides, a spacing between a center of one first sub-pixel of two first sub-pixels located on one side of the two adjacent sides and a center of the first sub-pixel 11*e* located inside the first virtual quadrangle 10*g* is not equal to a spacing between a center of an other first sub-pixel of the two first sub-pixels located on the one side of the two adjacent sides and the center of the first sub-pixel 11*e* located inside the first virtual quadrangle 10*g*, and a spacing between a center of one first sub-pixel of two first sub-pixels located on an other side of the two adjacent sides and the center of the first sub-pixel 11*e* located inside the first virtual quadrangle 10*g* is equal to a spacing between a center of an other first sub-pixel of the two first sub-pixels located on the other side of the two adjacent sides and the center of the first sub-pixel 11*e* located inside the first virtual quadrangle 10*g*.

In the present embodiment, the first sub-pixel 11*a* and the first sub-pixel 11*b* are located on the one side of the two adjacent sides of the first virtual quadrangle 10*g*, and the first sub-pixel 11*a* and the first sub-pixel 11*c* are located on a side of the two adjacent sides of the first virtual quadrangle 10*g* and adjacent to the one side. In an embodiment, a spacing x between a center of the first sub-pixel 11*a* and the center of the first sub-pixel 11*e* is equal to a spacing x between a center of the first sub-pixel 11*b* and the center of the first sub-pixel 11*e*; and the spacing x between the center of the first sub-pixel 11*a* and the center of the first sub-pixel 11*e* is not equal to a spacing y between a center of the first sub-pixel 11*c* and the center of the first sub-pixel 11*e*.

The first sub-pixel 11*c* and the first sub-pixel 11*d* are located on one side of the two adjacent sides of the first virtual quadrangle 10*g*, and the first sub-pixel 11*d* and the first sub-pixel 11*b* are located on a side of the two adjacent sides of the first virtual quadrangle 10*g* and adjacent to the one side. In an embodiment, a spacing y between a center of the first sub-pixel 11*c* and the center of the first sub-pixel 11*e* is equal to a spacing y between a center of the first sub-pixel 11*d* and the center of the first sub-pixel 11*e*; and the spacing y between the center of the first sub-pixel 11*d* and the center of the first sub-pixel 11*e* is not equal to the spacing x between the center of the first sub-pixel 11*b* and the center of the first sub-pixel 11*e*.

The pixel arrangement mode is used, and in the column direction, which is beneficial to the regular distribution of the first sub-pixels 11, so that the display serrated sense of a vertical line array of the first sub-pixels 11 in the column direction can be reduced, and the display effect can be improved.

Figure 11:
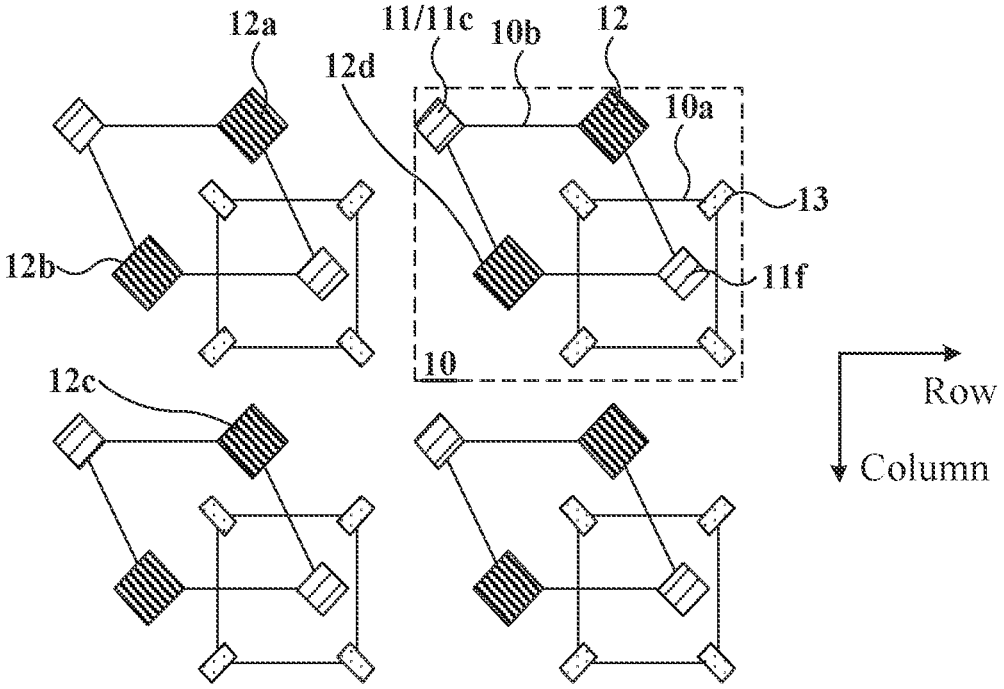
FIG. 11 is a schematic diagram of a display panel according to another embodiment of the present disclosure.
Figure 12:
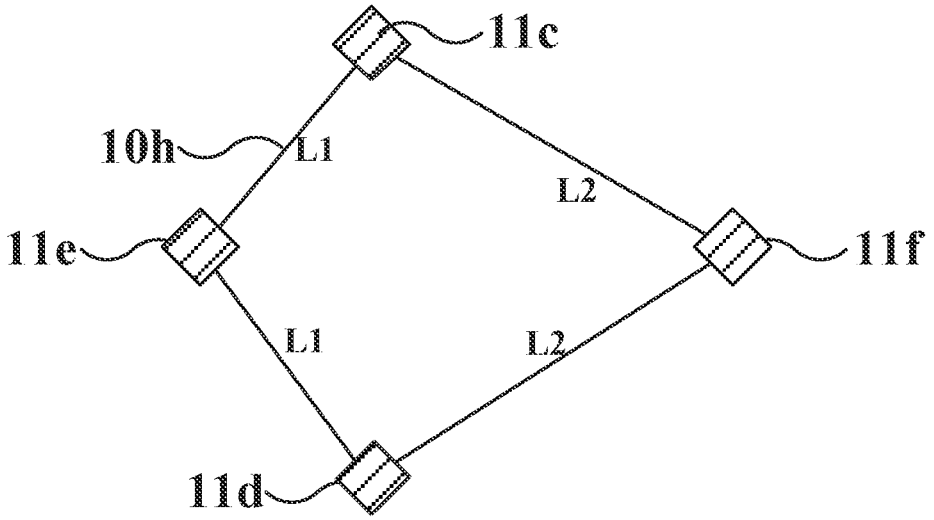
FIG. 12 is a partial schematic diagram of FIG. 11.

Referring to FIG. 11, FIG. 11 is a schematic diagram of a display panel according to another embodiment of the present disclosure, and FIG. 12 is a partial schematic diagram of FIG. 11. As shown in FIGS. 11 and 12, centers of four adjacent first sub-pixels 11 constitute a second virtual quadrangle 10*h*, and the second virtual quadrangle 10*h* includes a first side, a second side, a third side and a fourth side that are connected in turn, where a length of the first side is not equal to a length of the third side opposite to the first side; and a length of the second side is not equal to a length of the fourth side opposite to the second edge. The second virtual quadrangle 10*h* includes a first vertex, a second vertex, a third vertex and a fourth vertex, a first sub-pixel 11 of the four adjacent first sub-pixels 11 located on the first vertex and a first sub-pixel 11 of the four adjacent first sub-pixels 11 located on the third vertex opposite to the first vertex, are respectively located inside two adjacent first virtual squares 10*a*, and a first sub-pixel 11 of the four adjacent first sub-pixels 11 located on the second vertex and a first sub-pixel 11 of the four adjacent first sub-pixels 11 located on the fourth vertex opposite to the second vertex, each is located at a same position of a respective first virtual parallelogram 10*b* of two adjacent first virtual parallelograms 10*b*. The two adjacent first virtual parallelograms 10*b* are located at a same row, and the two adjacent first virtual squares 10*a* are located at a same column; or the two adjacent first virtual parallelograms 10*b* are located at a same column, and the two adjacent first virtual squares 10*a* are located at a same row.

In the present embodiment, the centers of the four adjacent first sub-pixels 11 constitute the second virtual quadrangle 10*h*. Two first sub-pixels 11 located on two opposite vertexes of the four vertexes of the second virtual quadrangle 10*h* are respectively located inside two adjacent first virtual squares 10*a*, and two first sub-pixels 11 located remaining two opposite vertexes of the four vertexes of the second virtual quadrangle 10*h* each is located at a same position of a respective first virtual parallelogram 10*b* of two adjacent first virtual parallelograms 10*b*. In an embodiment, the two adjacent first virtual parallelograms 10*b* are located at a same column, and the two adjacent first virtual squares 10*a* are located at a same row.

In the second virtual quadrangle 10*h*, a length of one side of two opposite sides is not equal to a length of an other side of two opposite sides. Therefore, a spacing between adjacent pixel repetitive units 10 in the row direction or the column direction can be flexibly designed to adjust the spacing between the first sub-pixel 11 and the second sub-pixel 12, to ease the light-stealing problem of the sub-pixels having different light-emitting colors.

In an embodiment, a length of the first side is equal to a length of the second side, and a length of the third side is equal to a length of the fourth side.

In the second virtual quadrangle 10*h*, the first side and the second side are adjacent and have a same length L1; and the third side and the fourth side are adjacent and have a same length L2.

Figure 13:
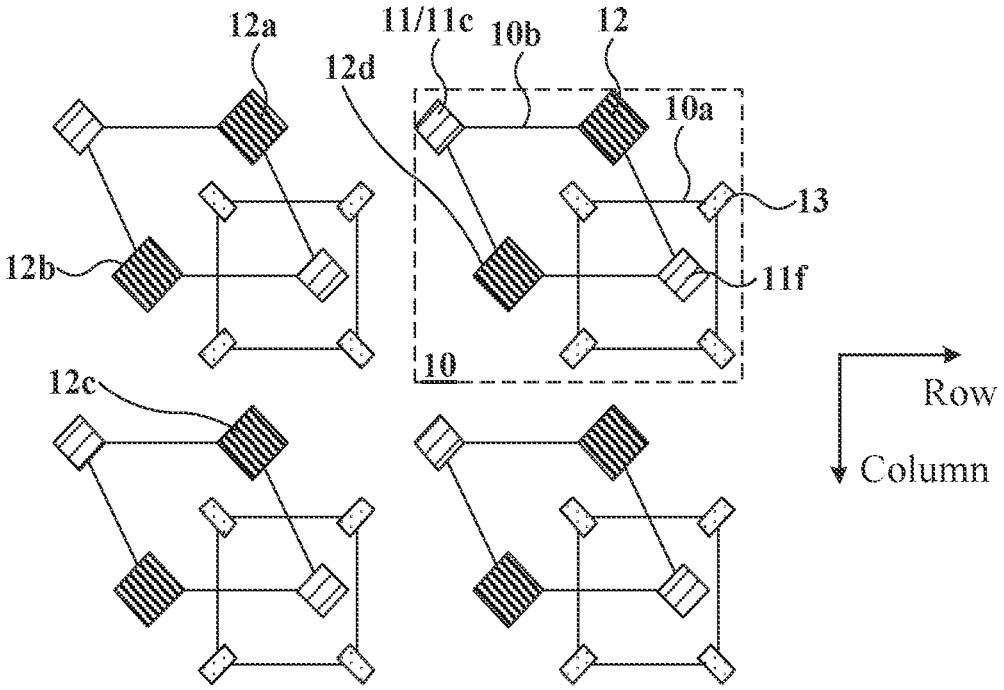
FIG. 13 is a schematic diagram of a display panel according to another embodiment of the present disclosure.
Figure 14:
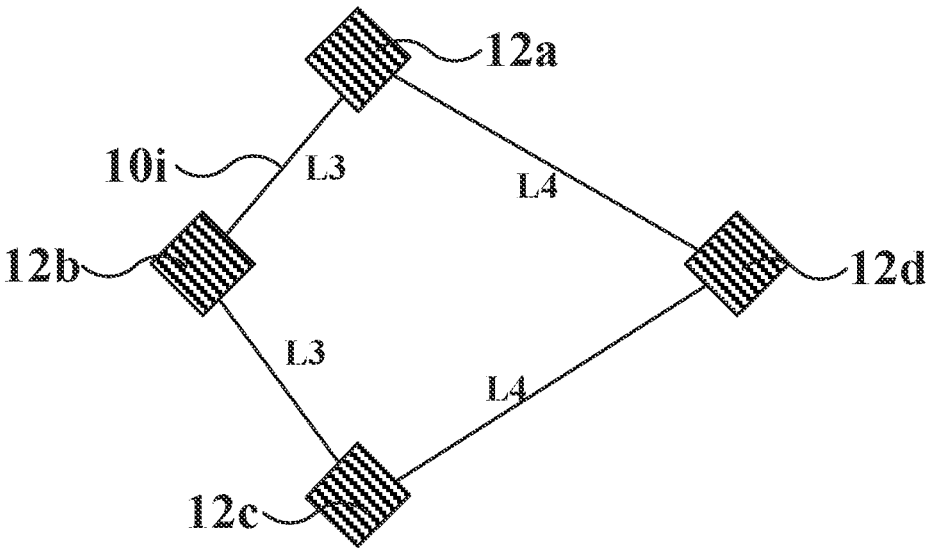
FIG. 14 is a partial schematic diagram of FIG. 13.

Referring to FIG. 13, FIG. 13 is a schematic diagram of a display panel according to another embodiment of the present disclosure, and FIG. 14 is a partial schematic diagram of FIG. 13. As shown in FIGS. 13 and 14, centers of four adjacent second sub-pixels 12 constitute a third virtual quadrangle 10*i*, and the third virtual quadrangle 10*i* includes a first side, a second side, a third side and a fourth side that are connected in turn, where a length of the first side is not equal to a length of the third side opposite to the first side; and a length of the second side is not equal to a length of the fourth side opposite to the second edge. The third virtual quadrangle 10*i* includes a first vertex, a second vertex, a third vertex and a fourth vertex, a second sub-pixel 12 of the four adjacent second sub-pixels 12 located on the first vertex and a second sub-pixel 12 of the four adjacent second sub-pixels 12 located on the third vertex opposite to the first vertex, each is located at a same position of a respective first virtual parallelogram 10*b* of two adjacent first virtual parallelograms 10*b* in the same row. Two second sub-pixels 12 of the four adjacent second sub-pixels 12 located on the second vertex and the fourth vertex opposite to the second vertex, each is located at a same position of a respective first virtual parallelogram 10*b* of two adjacent first virtual parallelograms 10*b* in the same column.

In the present embodiment, the centers of the four adjacent second sub-pixels 12 constitute the third virtual quadrangle 10*i*. Two second sub-pixels 12 located on two opposite vertexes of the four vertexes of the third virtual quadrangle 10*i*, each is located at a same position of a respective first virtual parallelogram 10*b* of two adjacent first virtual parallelograms 10*b* in the column direction, and two second sub-pixels 12 located remaining two opposite vertexes of the four vertexes of the third virtual quadrangle 10*i*, each is located at a same position of a respective first virtual parallelogram 10*b* of the two adjacent first virtual parallelograms 10*b* in the row direction.

In the third virtual quadrangle 10*i*, a length of one side of two opposite sides is not equal to a length of an other side of the two opposite sides. Therefore, a spacing between adjacent pixel repetitive units 10 in the row direction or the column direction can be flexibly designed to adjust the spacing between the first sub-pixel 11 and the second sub-pixel 12, to ease the light-stealing problem of the sub-pixels having different light-emitting colors.

In an embodiment, a length of the first side is equal to a length of the second side, and a length of the third side is equal to a length of the fourth side.

In the third virtual quadrangle 10*i*, the first side and the second side are adjacent and have a same length which is L3; and the third side and the fourth side are adjacent and have a same length which is L4.

In an embodiment, an area of the second virtual quadrangle 10*h* is same as an area of the third virtual quadrangle 10*i*. In an embodiment, L1=L4, L2=L3.

The first sub-pixels and the second sub-pixels are designed in such an arrangement mode, the spacing between the first sub-pixels and the second sub-pixels is relatively large, and the contact between the first sub-pixels and the second sub-pixels is less, whereby the light-stealing problem of sub-pixels can be relieved. The arrangement of the first sub-pixels or the second sub-pixels in the row direction or the column direction can be flexibly designed to improve the display serrated sense of the vertical line array of the first sub-pixels or the second sub-pixels and to improve the display effect.

Figure 15:
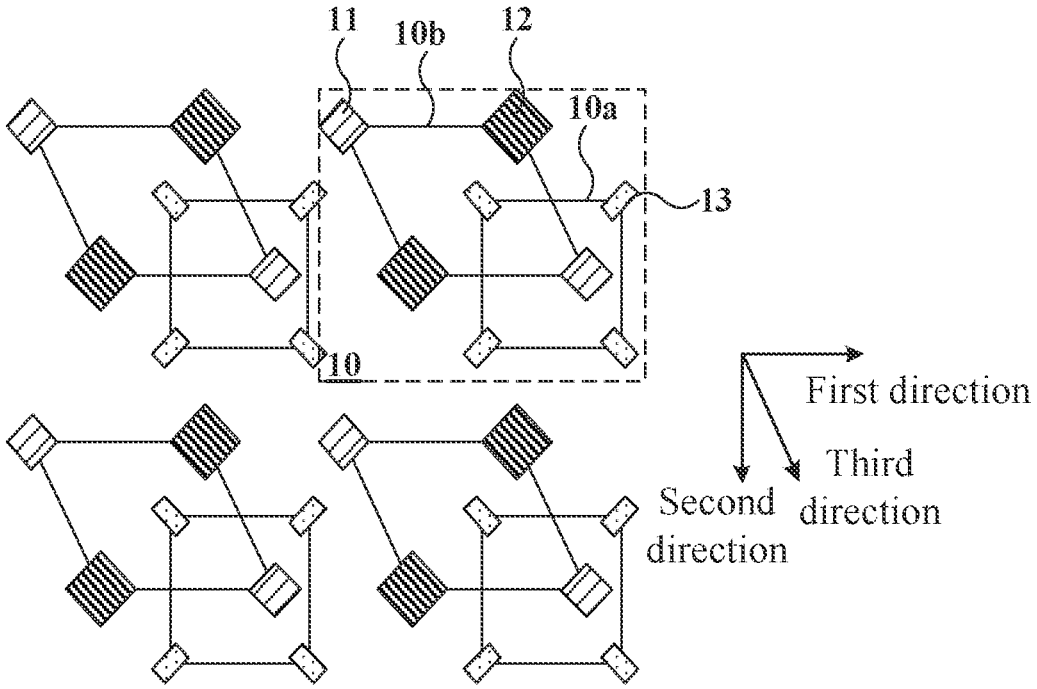
FIG. 15 is a schematic diagram of a display panel according to another embodiment of the present disclosure.

With reference to FIG. 15, FIG. 15 is a schematic diagram of a display panel according to another embodiment of the present disclosure. As shown in FIG. 15, a side of the first virtual parallelogram 10*b* is parallel to a side of the first virtual square 10*a*.

In the present embodiment, the first virtual parallelogram 10*b* includes two sides extending along a first direction and two sides extending along a third direction, and the third direction intersects and is not perpendicular to the first direction. The first virtual square 10*a* includes two sides extending along the first direction and two sides extending along a second direction, and the second direction intersects and is perpendicular to the first direction.

The pixel arrangement mode is used, which facilitates a uniform distribution of the first sub-pixels 11, the second sub-pixels 12 and the third sub-pixels 13 along the first direction, whereby the difficulty of a manufacturing process can be reduced, and the display serrated sense of the straight line in the first direction can be decreased.

Figure 16:
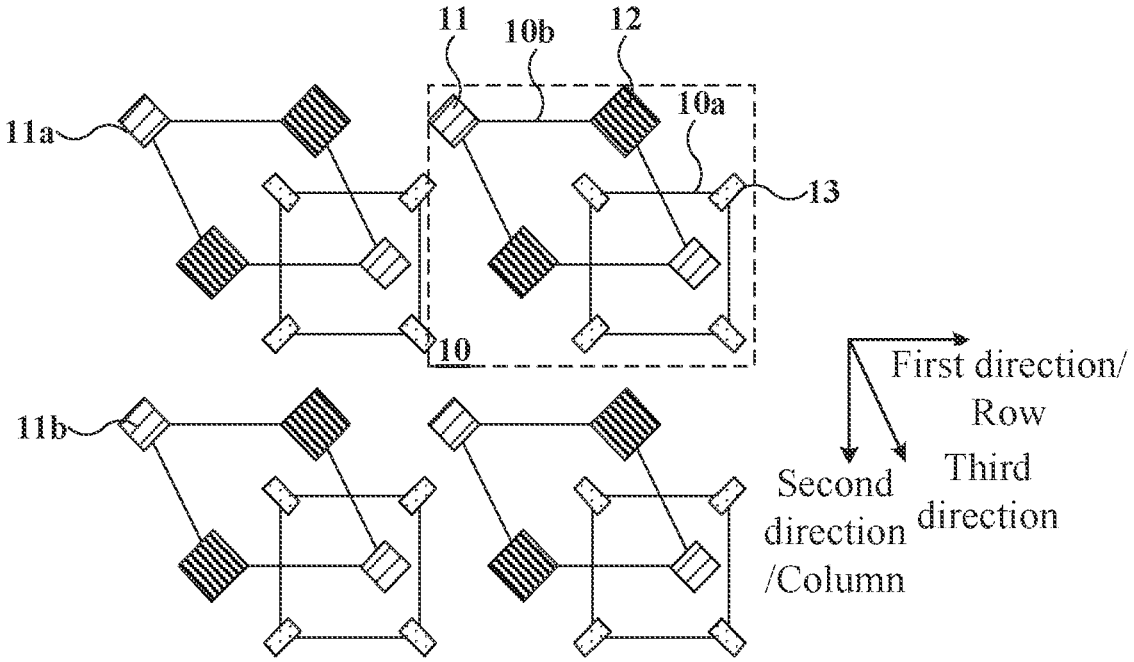
FIG. 16 is a schematic diagram of a display panel according to another embodiment of the present disclosure.

With reference to FIG. 16, FIG. 16 is a schematic diagram of a display panel according to another embodiment of the present disclosure. As shown in FIG. 16, the first virtual parallelogram 10*b* includes two adjacent sides, one of the two adjacent sides is parallel to a row direction, an other one of the two adjacent sides intersects a column direction, and the row direction intersects the column direction.

In the present embodiment, the first direction is the row direction, the second direction is the column direction, and the third direction intersects and is not perpendicular to the first direction. Two opposite sides of the first virtual parallelogram 10 extend along the row direction. Such a pixel arrangement mode facilitates uniform distribution of the first sub-pixels 11, the second sub-pixels 12 and the third sub-pixels 13 along the row direction or the column direction, the difficulty of a manufacturing process can be reduced, and the display serrated sense of the straight line in the row direction or in the column direction can be decreased.

In an embodiment, in the column direction, a range of a spacing between centers of two adjacent first sub-pixels 11 and a range of a spacing between centers of two adjacent second sub-pixels 12 are PP/32~PP/8. PP is a spacing between centers of two first sub-pixels 11 each at a same position in a respective pixel repetitive unit 10 of two adjacent pixel repetitive units 10 along the column direction.

As described above, in the column direction, a position of the first sub-pixel 11*a* in a pixel repetitive unit 10 of the two adjacent pixel repetitive units 10 is the same as a position of the first sub-pixel 11*b* in another pixel repetitive unit 10 of the two adjacent pixel repetitive units 10, and a spacing between a center of the first sub-pixel 11*a* and a center of the first sub-pixel 11*b* is PP, so that in the column direction, the range of the spacing between centers of two adjacent first sub-pixels 11 and the range of the spacing between centers of two adjacent second sub-pixels 12 are PP/32~PP/8.

When the pixels are arranged in the above arrangement mode, the spacing between the first sub-pixels 11 and the second sub-pixels 12 is relatively large, and the contact between the first sub-pixels 11 and the second sub-pixels 12 is reduced, the light-stealing problem of the first sub-pixels 11 and the second sub-pixels 12 can be eased, and the display effect can be improved.

As shown in FIG. 16, the first virtual square 10*a* includes two adjacent sides, one of the two adjacent sides is parallel to the row direction, and the other one of the two adjacent sides is parallel to the column direction, where the row direction intersects the column direction. By using the above pixel arrangement mode, geometrical centers of third sub-pixels 13 in one row and in the row direction are located on a same straight line, so that the display serrated sense of the straight line is decreased in the row direction; and geometrical centers of third sub-pixels 13 in one column and in the column direction are located on a same straight line, so that the display serrated sense of the straight line is decreased in the column direction. Therefore, the display effect is improved.

For the display panel described in any of the above embodiments, each first sub-pixel 11, each second sub-pixel 12 and each third sub-pixel 13 are quadrangular in shape. In the present embodiment, the first sub-pixels 11 and the second sub-pixel 12 both are quadrangular in shape. A shape of a light-emitting region of the each first sub-pixel 11 is quadrangle, and a shape of a light-emitting region of the each second sub-pixel 12 is quadrangle. The quadrilateral light-emitting region is used, and sides of the light-emitting regions of the sub-pixels having different light-emitting colors can be made relatively close, which is beneficial to better color mixing among the sub-pixels having different light-emitting colors in the pixel repetitive units 10.

In an embodiment, the light emitting color of the first sub-pixels 11, the light emitting color of the second sub-pixels 12 and the light emitting color of the third sub-pixels 13 each is a respective one of red, green and blue. In an embodiment, the light emitting color of the third sub-pixels sub-pixel 13 is green. Human eyes are sensitive to green. The third sub-pixels 13 are disposed to emit green light, and the centers of the four third sub-pixels 13 in each pixel repetitive unit 10 constitute a first virtual square 10*a*, so that the geometrical centers of the light-emitting regions of green sub-pixels in one row are located on a same horizontal line, which can reduce the serrated sense in the row direction; and the geometrical centers of the light-emitting regions of green sub-pixels in one column are located in a same vertical line, which can reduce the display serrated sense of the vertical line in the column direction; whereby the display effect is improved.

Figure 17:
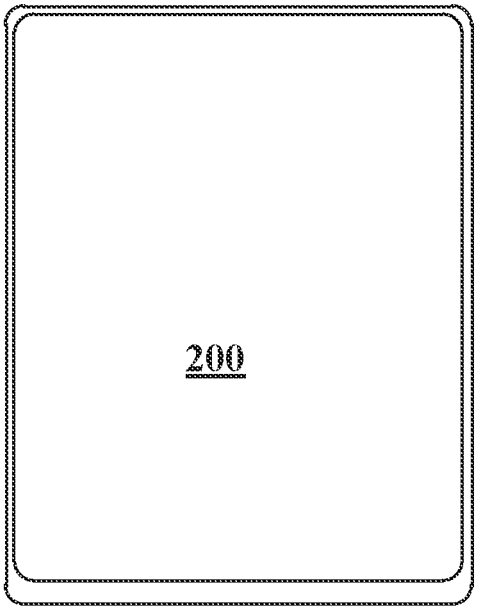
FIG. 17 is a schematic diagram of a display device according to an embodiment of the present disclosure.

Based on a same inventive concept, an embodiment of the present disclosure further provides a display device. With reference to FIG. 17, FIG. 17 is a schematic diagram of a display device according to an embodiment of the present disclosure. As shown in FIG. 17, the display device includes the display panel described in any embodiment, the display device has same or corresponding beneficial effects as the display panel included therein.

What is claimed is:

1. A display panel, comprising:

a plurality of pixel repetitive units arranged in array, wherein each pixel repetitive unit of the plurality of pixel repetitive units comprises two first sub-pixels, two second sub-pixels and four third sub-pixels, and a light emitting color of the two first sub-pixels, a light emitting color of the two second sub-pixels and a light emitting color of the four third sub-pixels are different; and for the each pixel repetitive unit, centers of the four third sub-pixels constitute a first virtual square, one first sub-pixel of the two first sub-pixels is located inside the first virtual square, and a center of the first virtual square does not overlap a center of the one first sub-pixel located inside the first virtual square; and centers of the two first sub-pixels and centers of the two second sub-pixels constitute a first virtual parallelogram, and one third sub-pixel of the four third sub-pixels is located inside the first virtual parallelogram;

wherein centers of two first sub-pixels and centers of two second sub-pixels on two opposite sides of two adjacent first virtual parallelograms constitute a second virtual parallelogram, and one third sub-pixel of the four third sub-pixels is located inside the second virtual parallelogram;

wherein a center of the second virtual parallelogram does not overlap a center of the one third sub-pixel located inside the second virtual parallelogram;

wherein in one column of pixel repetitive units of the plurality of pixel repetitive units, a plurality of first sub-pixels each located at a same position of a respective pixel repetitive unit of the one column of pixel repetitive units are located on a same straight line, and a plurality of second sub-pixels each located at a same position of a respective pixel repetitive unit of the one column of pixel repetitive units are located on a same straight line; and wherein along a column direction, the first virtual parallelogram and the second virtual parallelogram adjacent to each other, are distributed axisymmetrically along a common side of the first virtual parallelogram and the second virtual parallelogram.

2. The display panel of claim 1, wherein a center of the first virtual parallelogram does not overlap a center of the one third sub-pixel located inside the first virtual parallelogram.

3. The display panel of claim 1, wherein a spacing a is provided between a center of each third sub-pixel of the four third sub-pixels and a center of one first sub-pixel of the two first sub-pixels adjacent to the each third sub-pixel, and a spacing c is provided between the center of the each third sub-pixel and a center of an other first sub-pixel of the two first sub-pixels adjacent to the each third sub-pixel; and a spacing b is provided between a center of the each third sub-pixel and a center of one second sub-pixel of the two second sub-pixels adjacent to the each third sub-pixel, and a spacing d is provided between the center of the each third sub-pixel and a center of an other second sub-pixel of the two second sub-pixels adjacent to the each third sub-pixel;

wherein $a \neq b \neq c \neq d$ or $a = b \neq c \neq d$ or $a = d \neq c \neq b$.

4. The display panel of claim 1, wherein centers of four third sub-pixels on two opposite sides of two adjacent first virtual squares constitute a first virtual rectangle, and one second sub-pixel of the two second sub-pixels is located inside the first virtual rectangle.

5. The display panel of claim 4, wherein a center of the first virtual rectangle does not overlap a center of the one second sub-pixel located inside the first virtual rectangle; and wherein two adjacent sides of the first virtual rectangle are equal in length.

6. The display panel of claim 1, wherein in four adjacent pixel repetitive units of the plurality of pixel repetitive units, centers of four first sub-pixels each located at a same position of a respective pixel repetitive unit of the four adjacent pixel repetitive units constitute a first virtual quadrangle, a first sub-pixel of a pixel repetitive unit of the four adjacent pixel repetitive units is located inside the first virtual quadrangle, and has a center not overlapping a center of the first virtual quadrangle.

7. The display panel of claim 6, wherein the first virtual quadrangle comprises two adjacent sides, a spacing between a center of one first sub-pixel of two first sub-pixels located on one side of the two adjacent sides and a center of the first sub-pixel located inside the first virtual quadrangle is not equal to a spacing between a center of an other first sub-pixel of the two first sub-pixels located on the one side of the two adjacent sides and the center of the first sub-pixel located inside the first virtual quadrangle, and a spacing between a center of one first sub-pixel of two first sub-pixels located on an other side of the two adjacent sides and the center of the first sub-pixel located inside the first virtual quadrangle is equal to a spacing between a center of an other first sub-pixel of the two first sub-pixels located on the other side of the two adjacent sides and the center of the first sub-pixel located inside the first virtual quadrangle.

8. The display panel of claim 1, wherein centers of four adjacent first sub-pixels constitute a second virtual quadrangle, and the second virtual quadrangle comprises a first side, a second side, a third side and a fourth side that are connected in turn, wherein a length of the first side is not equal to a length of the third side opposite to the first side; and a length of the second side is not equal to a length of the fourth side opposite to the second side; and wherein the second virtual quadrangle comprises a first vertex, a second vertex, a third vertex and a fourth vertex, a first sub-pixel of the four adjacent first sub-pixels located on the first vertex and a first sub-pixel of the four adjacent first sub-pixels located on the third vertex opposite to the first vertex, are respectively located inside two adjacent first virtual squares, and a first sub-pixel of the four adjacent first sub-pixels located on the second vertex and a first sub-pixel of the four adjacent first sub-pixels located on the fourth vertex opposite to the second vertex, each is located at a same position of a respective first virtual parallelogram of two adjacent first virtual parallelograms, wherein the two adjacent first virtual parallelograms are located at a same row, and the two adjacent first virtual squares are located at a same column; or the two adjacent first virtual parallelograms are located at a same column, and the two adjacent first virtual squares are located at a same row.

9. The display panel of claim 8, wherein centers of four adjacent second sub-pixels constitute a third virtual quadrangle, and the third virtual quadrangle comprises a first side, a second side, a third side and a fourth side that are connected in turn, wherein a length of the first side is not equal to a length of the third side opposite to the first side; and a length of the second side is not equal to a length of the fourth side opposite to the second side; and wherein the third virtual quadrangle comprises a first vertex, a second vertex, a third vertex and a fourth vertex, a second sub-pixel of the four adjacent second sub-pixels located on the first vertex and a second sub-pixel of the four adjacent second sub-pixels located on the third vertex opposite to the first vertex, each is located at a same position of a respective first virtual parallelogram of two adjacent first virtual parallelograms in the same row, and a second sub-pixel of the four adjacent second sub-pixels located on a second vertex and a second sub-pixel of the four adjacent second sub-pixels located on the fourth vertex opposite to the second vertex, each is located at a same position of a respective first virtual parallelogram of two adjacent first virtual parallelograms in the same column.

10. The display panel of claim 9, wherein a length of the first side is equal to a length of the second side, and a length of the third side is equal to a length of the fourth side; and wherein an area of the second virtual quadrangle is same as an area of the third virtual quadrangle.

11. The display panel of claim 1, wherein a side of the first virtual parallelogram is parallel to a side of the first virtual square.

12. The display panel of claim 1, wherein the first virtual parallelogram comprises two adjacent sides, one of the two adjacent sides is parallel to a row direction, an other one of the two adjacent sides intersects a column direction, and the row direction intersects the column direction.

13. The display panel of claim 1, wherein the first virtual square comprises two adjacent sides, one of the two adjacent sides is parallel to a row direction, an other one of the two adjacent sides is parallel to a column direction, and the row direction intersects the column direction.

14. The display panel of claim 1, wherein each of the two first sub-pixels, each of the two second sub-pixels and each of the four third sub-pixels are quadrangular in shape.

15. The display panel of claim 1, wherein the light emitting color of the two first sub-pixels, the light emitting color of the two second sub-pixels and the light emitting color of the four third sub-pixels each is a respective one of red, green and blue.

16. The display panel of claim 15, wherein the light emitting color of the four third sub-pixels is green.

17. A display device, comprising:

a display panel, wherein the display panel comprises:

a plurality of pixel repetitive units arranged in array, wherein each pixel repetitive unit of the plurality of pixel repetitive units comprises two first sub-pixels, two second sub-pixels and four third sub-pixels, and a light emitting color of the two first sub-pixels, a light emitting color of the two second sub-pixels and a light emitting color of the four third sub-pixels are different; and for the each pixel repetitive unit, centers of the four third sub-pixels constitute a first virtual square, one first sub-pixel of the two first sub-pixels is located inside the first virtual square, and a center of the first virtual square does not overlap a center of the one first sub-pixel located inside the first virtual square; and centers of the two first sub-pixels and centers of the two second sub-pixels constitute a first virtual parallelogram, and one third sub-pixel of the four third sub-pixels is located inside the first virtual parallelogram;

wherein centers of two first sub-pixels and centers of two second sub-pixels on two opposite sides of two adjacent first virtual parallelograms constitute a second virtual parallelogram, and one third sub-pixel of the four third sub-pixels is located inside the second virtual parallelogram;

wherein a center of the second virtual parallelogram does not overlap a center of the one third sub-pixel located inside the second virtual parallelogram;

wherein in one column of pixel repetitive units of the plurality of pixel repetitive units, a plurality of first sub-pixels each located at a same position of a respective pixel repetitive unit of the one column of pixel repetitive units are located on a same straight line, and a plurality of second sub-pixels each located at a same position of a respective pixel repetitive unit of the one column of pixel repetitive units are located on a same straight line; and wherein along a column direction, the first virtual parallelogram and the second virtual parallelogram adjacent to each other, are distributed axisymmetrically along a common side of the first virtual parallelogram and the second virtual parallelogram.

* * * * *